US011377768B2

(12) United States Patent
Pan

(10) Patent No.: US 11,377,768 B2
(45) Date of Patent: Jul. 5, 2022

(54) FEED ASSIST APPARATUS FOR A FLEXIBLE SHEET MATERIAL SPREADER

(71) Applicant: GERBER TECHNOLOGY LLC, Tolland, CT (US)

(72) Inventor: Hong Pan, Glastonbury, CT (US)

(73) Assignee: GERBER TECHNOLOGY LLC, Tolland, CT (US)

( * ) Notice: Subject to any disclaimer, the term of this patent is extended or adjusted under 35 U.S.C. 154(b) by 233 days.

(21) Appl. No.: 16/884,863

(22) Filed: May 27, 2020

(65) Prior Publication Data

US 2020/0378047 A1 Dec. 3, 2020

Related U.S. Application Data

(60) Provisional application No. 62/855,516, filed on May 31, 2019.

(51) Int. Cl.

| | |
|---|---|
| ***D06C 3/06*** | (2006.01) |
| ***B65H 20/02*** | (2006.01) |
| ***B65H 23/02*** | (2006.01) |
| ***B65H 23/022*** | (2006.01) |

(52) U.S. Cl.

CPC ..... *D06C 3/06* (2013.01); *B65H 20/02* (2013.01); *B65H 23/02* (2013.01); *B65H 23/022* (2013.01); *B65H 2301/11* (2013.01); *B65H 2301/522* (2013.01); *B65H 2404/144* (2013.01); *B65H 2701/174* (2013.01)

(58) Field of Classification Search

CPC ..... D06C 3/06; B65H 20/02; B65H 23/02; B65H 2301/11; B65H 2404/144; B65H 2701/174; D06F 67/04

See application file for complete search history.

(56) References Cited

FOREIGN PATENT DOCUMENTS

CN 106006163 A 10/2016

OTHER PUBLICATIONS

International Search Report and Written Opinion with English language translation of CN106006163A, issued in corresponding international application No. PCT/US2020/034687, dated Aug. 26, 2020. (22 pages).

*Primary Examiner* — William E Dondero

(74) *Attorney, Agent, or Firm* — Day Pitney LLP; George N. Chaclas

(57) ABSTRACT

A feed assist apparatus for a flexible sheet material spreader, comprising a first arm attached at a first end to one side of the material spreader, a second arm attached at a first end to another side of the material spreader, and a material retainer attached at a second end of each of the first and second arms, the material retainer having a first configuration for feeding flexible sheet material there-through and a second configuration for retaining flexible sheet material. The first arm and the second arm are moveable together from a first position adjacent a flexible material supply and a second position adjacent entry to the material spreader, and the material retainer is in the second configuration when the moveable arms are in the first position, and the material retainer is in the first configuration when the moveable arms are in the second position.

19 Claims, 5 Drawing Sheets

FEED ASSIST APPARATUS FOR A FLEXIBLE SHEET MATERIAL SPREADER

RELATED APPLICATIONS

This application claims priority to U.S. Provisional Application No. 62/855,516, filed May 31, 2019, the disclosure and teachings of which are incorporated herein by reference for any purpose whatsoever.

BACKGROUND OF THE INVENTION

1. Field of the Invention

The invention disclosed herein relates to a single operator spreading and material feeding apparatus, and in particular to an apparatus for dispensing fabric that is unrolled one ply at a time.

2. Description of the Related Art

Sheet material, such as cloth, laminates, and the like, is used in a variety of products. Included are garments, upholstery, and many other products. High production volume necessitates efficient work practices with sophisticated equipment. Examples of equipment useful for preparing sheet material in the manufacturing process include cutting tables and fabric spreaders. Generally, a fabric spreader will spread the sheet material for subsequent cutting with the cutting table. The exceedingly competitive nature of such enterprises requires manufacturers to work quickly and make as much use as possible of the sheet material consumed.

Fabric spreaders are generally part of a system, in which the fabric spreader is disposed over a table. The fabric spreader contains an operator panel, throttle, and controller, whereby the operator panel and throttle communicate with the controller to control various sub-components of the fabric spreader.

Fabric spreaders utilize a cradle to support the roll of material that is rolled one ply at a time as the fabric spreader advances over a table. The cradle has a fabric supply for loading a roll of material and using it for spreading. The cradle may be bounded by a series of belts, which are driven by a driven roller. The belts are driven by a motor that is remote from the cradle. As the driven roller spins, it causes the belts to move about idler rollers. When the roll of material is placed within the cradle, action of the belts causes the roll of material to spin as well. The spinning of the roll of material provides for dispensing of the fabric to the fabric spreader.

Depicted in FIG. 1 is a conventional fabric spreader. The fabric spreader can have a V-shaped cradle, including a first arm and a second arm, and have a length at least equal to that of the material. Generally, between the first arm and the second arm of the V-shaped cradle is a material fabric supply (not pictured), wherein a roll of material or a bundle of material can be positioned for spreading. More information regarding conventional fabric spreaders can be found in co-pending U.S. patent application Ser. No. 16/204,127.

Both flattening and coning of the roll of material are conditions that cause inconsistent dispensing of fabric from the roll of material. Aside from the dispensing of fabric from the roll of material under a consistent, constant tension, it is advantageous to dispense the fabric in a constant orientation. Accordingly, adjustment of the positioning of the roll of material during production to accommodate such goals provides for improved fabrication processes.

Typically, to ensure proper spreading of the material, two operators tug laterally on the material to provide uniform distribution and remove wrinkles in the material. Performing this process with one operator is challenging, generally two operators work simultaneously to smooth and position the fabric.

Thus, what are needed are methods and system to provide improved dispensing of sheet of material from a spreading machine using only one operator, thereby increasing efficiency, reducing setup time, and improving safety. Preferably, the system may be supplied as part of a new spreading machine or as a retrofit to an existing spreading machine.

SUMMARY OF THE INVENTION

Disclosed herein is a feed assist apparatus for a flexible sheet material spreader, more particularly for feeding fabric. The feed assist apparatus for a flexible sheet material spreader includes a material retainer and swing arm, the pinch roller is preferably self-releasing. The feed assist apparatus for a flexible sheet material spreader of the present disclosure is configured to evenly spread material on a material assembly for later cutting. Preferably, by incorporating the use of a swing arm and the material retainer into the feed assist apparatus for a flexible sheet material spreader, the feed assist apparatus for a flexible sheet material spreader can feed fan folded material, or a roll of material, evenly onto a table using solely one operator.

The feed assist apparatus for a flexible sheet material spreader includes a swing arm, having a material retainer, preferably comprised of a pinch roller, stationary roller, and guide plates. The pinch roller can be moved between a released position and a load position, preferably by an operator. In a release configuration, the pinch roller is positioned at a second end of a guide plate, preferably distal to the stationary roller, located at a first end of a guide plate, at a pre-determined distance. The release position thereby allows the insertion or release of fabric between the stationary roller and pinch roller. Alternatively, the pinch roller can be moved to a load position wherein the pinch roller is positioned adjacent to the stationary roller, such that a piece of material is secured between the pinch roller and the stationary roller.

The swing arm can be moved using a set of arms attached from the guide plates to a pivot point of a fabric spreader. The spreading panel can include a hollow curve attached to a flat table-like structure, assisting in maintaining tension within the fabric for even spreading.

BRIEF DESCRIPTION OF THE DRAWINGS

The features and advantages of the invention are apparent from the following description taken in conjunction with the accompanying drawings in which.

DETAILED DESCRIPTION OF THE INVENTION

Figure 1:
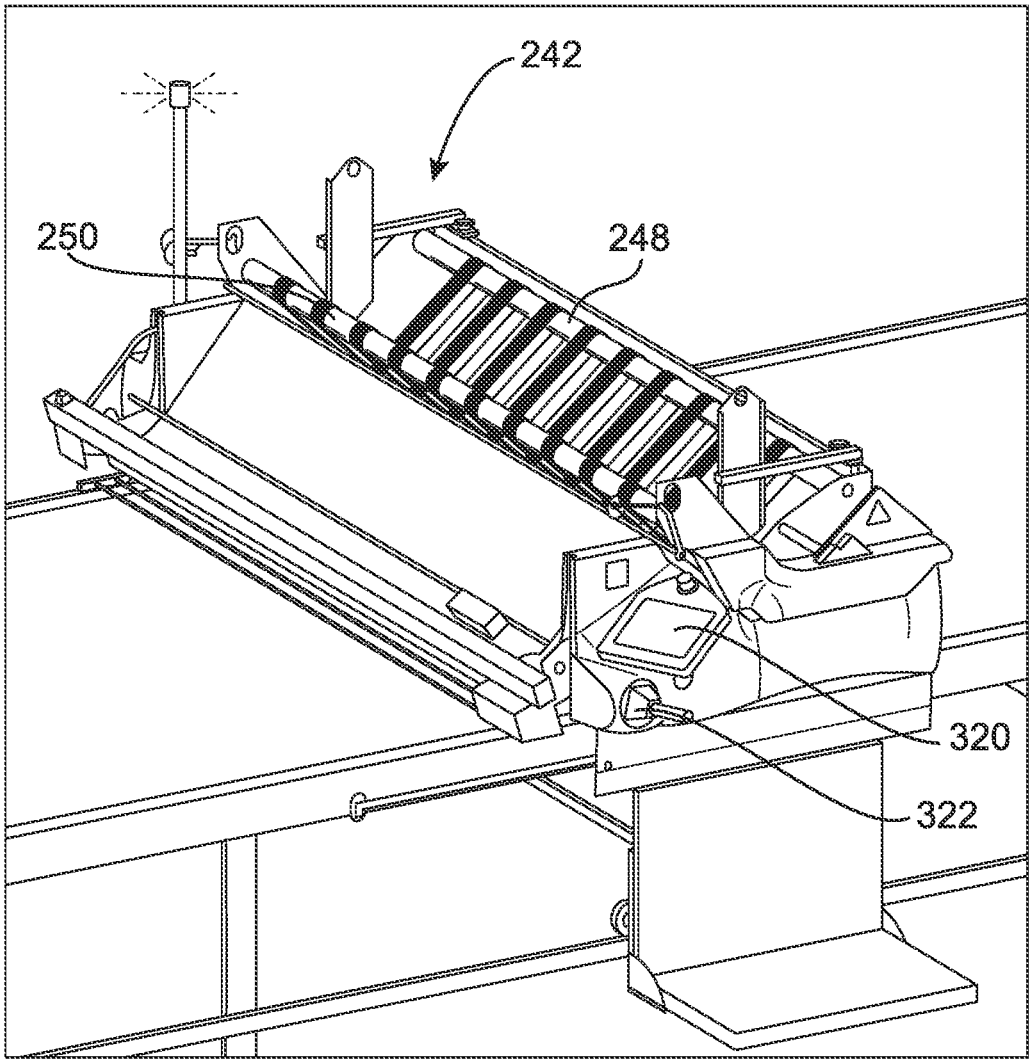
FIG. 1 (PRIOR ART)
FIG. 1 is an illustration of a conventional fabric spreader.

Disclosed herein is an apparatus for dispensing sheet material in a material spreading machine while only using one operator. Advantageously, application of the methods and system results in a substantially uniform dispensing of the sheet material for fabrication processes using only one operator.

Generally, a material spreading machine, or "fabric spreader" is a machine useful for spreading sheet material for one or more fabric layers. Specifically, in a production environment for spreading one or more fabric layers on a cutting table. The sheet material may be spread to provide for subsequent cutting of the material to a desired size. In embodiments disclosed herein, the material spreading machine is used for production of consumer goods such as garments, upholstery for residential, commercial and/or automotive furnishings and for other similar products.

The term "material" is used herein related to material that is supplied in a fanfold or roll form for use with the workstation described herein. Any other forms of material as deemed suitable may be used with the teachings herein. The term "fabric" may be used interchangeably with the term "material." No limitations are to be construed by the terminology used.

Disclosed herein is a preferred embodiment of the invention. The present invention comprises a feed assist apparatus for a flexible sheet material spreader including flexible material 208, preferably fabric, and a swing arm 260. In the embodiment depicted in FIGS. 2 and 3, a fabric supply, which in this embodiment is a folded bundle 206 of material 208, having a leading raw edge 210, is positioned on the top surface 214 of a table 212. It may be appreciated that a second embodiment of the system can exist wherein the folded bundle of material is a roll of material.

Positioned at a pre-determined distance above the table 212 is a guide rod 226. The left 228 and right (not pictured) sides of the guide rod 226 are attached to a set of arms 236, and the guide rod 226 has a length at least equal to that of the material 208. It may be appreciated that a single operator (not pictured) can pull the leading edge 210 of the material 208 over the top surface 232 of the guide rod 226, to guide the material 208 to the pinch roller 272 and stationary roller 278.

Figure 2:
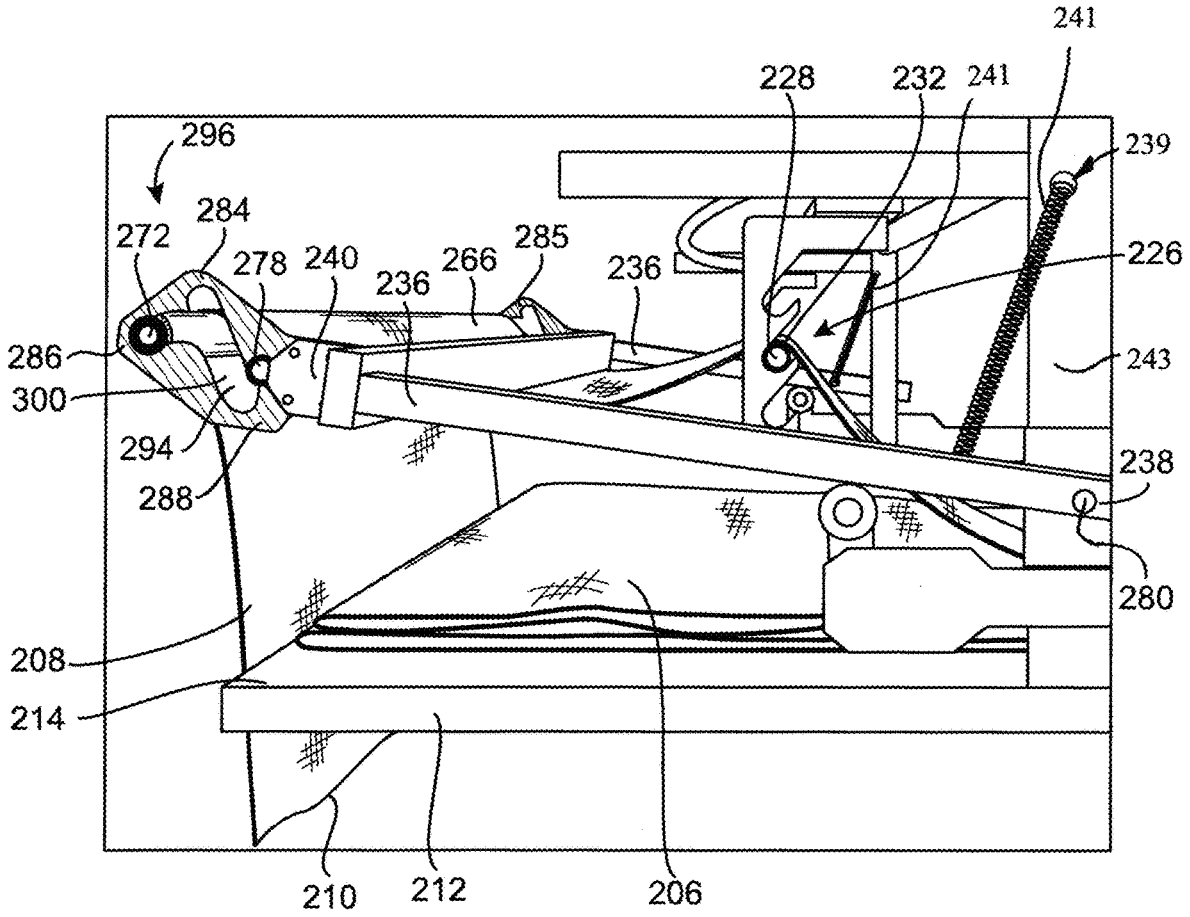
FIG. 2 is a view of the feed assist apparatus for a flexible sheet material spreader wherein the material retainer is in the pre-load position.
Figure 5:
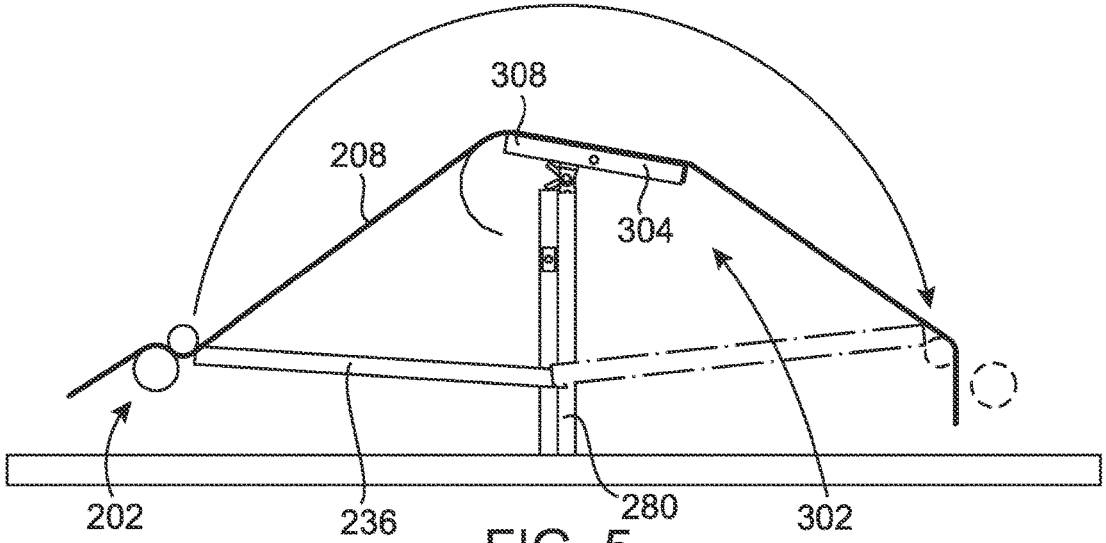
FIG. 5 is an illustration of the material retainer and swing arm, spreading the material over the spreading panel.

Each arm within the set of arms 236 has a first end 238 and a second end 240. The first ends 238 of the arms 236 can be attached to a pivot point 280 located on the material spreader, as illustrated in FIGS. 2 and 5. The second ends 240 of the arms 236 may extend to first 284 and second 285 guide plates. Once an operator pulls the leading edge 210 of the material 208 over the top surface 232 of the guide rod 226, the operator may further pull the leading edge 210 over the top surface 266 of a pinch roller 272.

The pinch roller 272 is positioned between the first and second guide plates 284, 285, such that each end of the pinch roller 272 is secured within the elongated slots 294 of each guide plate 284, 285. The pinch roller 272 may be comprised of, but is not limited to, a metal tube coated with uniform elastomer along its axial direction. It may be appreciated that the width, diameter, and durometer of the elastomer coating may vary depending on the properties of materials the pinch roller 272 will transport. As see in FIG. 3, positioned above and adjacent to the pinch roller 272 is a stationary roller 278. Similarly, the stationary roller 278 is positioned within the elongated slots 294 of each guide plate 284, 285.

The guide plates 284, 285 assist in guiding the material 208 over the top surface 266 of the pinch roller 272. As seen in FIG. 2, the guide plates 284, 285 have first 286 and second 288 ends, the first ends 286 are adjacent to the pinch roller 272, and the second ends 288 are adjacent to the second ends 240 of the arms 236. Each guide plate 284, 285 may have elongated slots 294. Preferably, as seen in the example in FIG. 3, the elongated slots 294 have a long end 216 and a short end 218.

Figure 3:
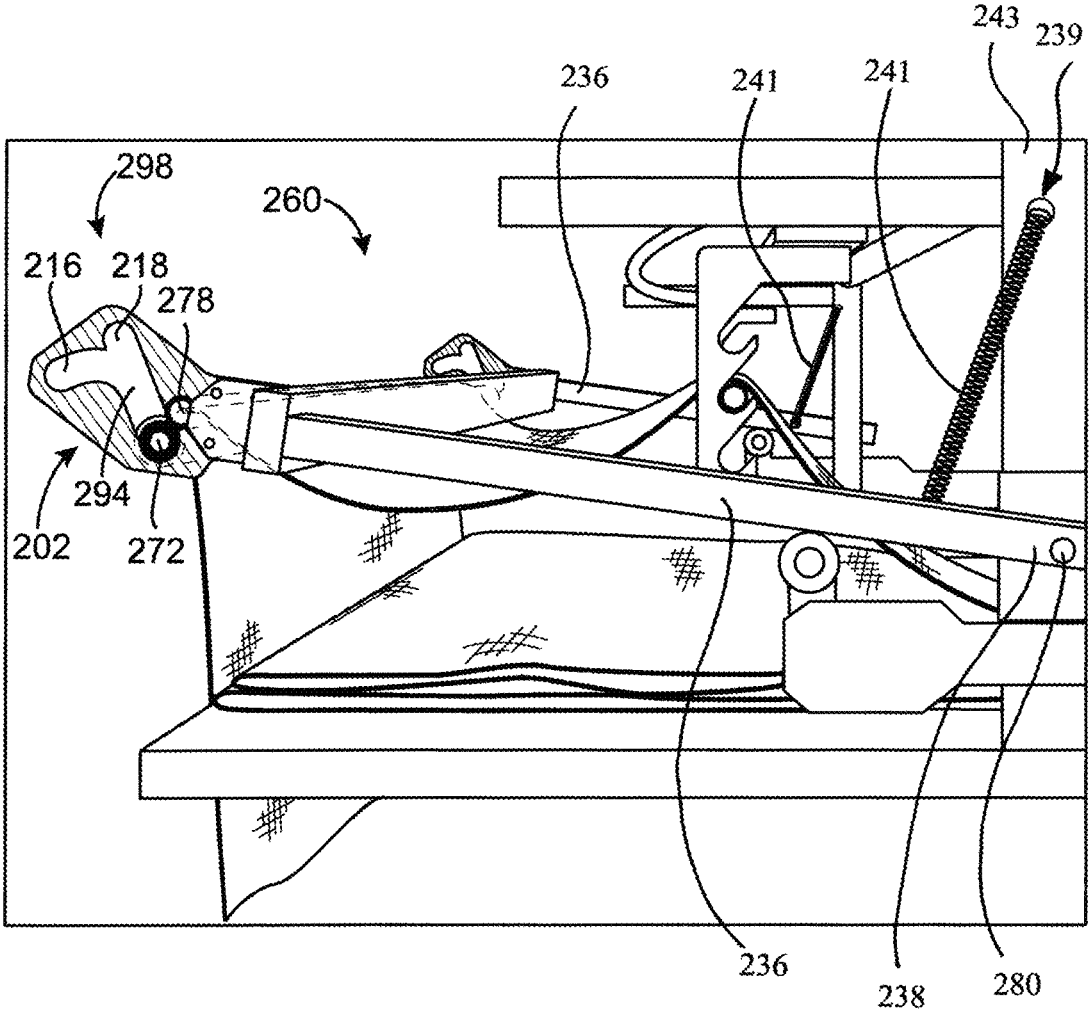
FIG. 3 is a second view of the feed assist apparatus for a flexible sheet material spreader wherein the material retainer is in a load position.
Figure 6A:
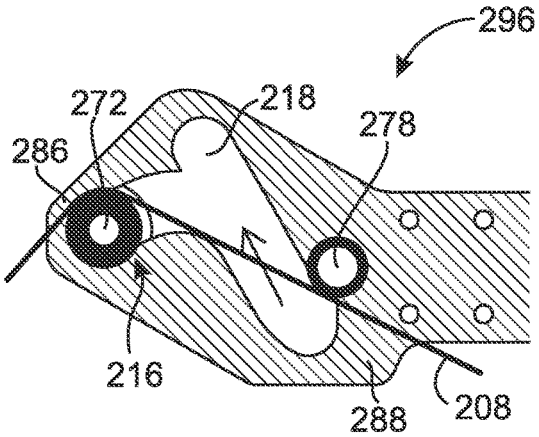
FIG. 6A is a simplified view of the material retainer in the pre-load position.
Figure 6B:
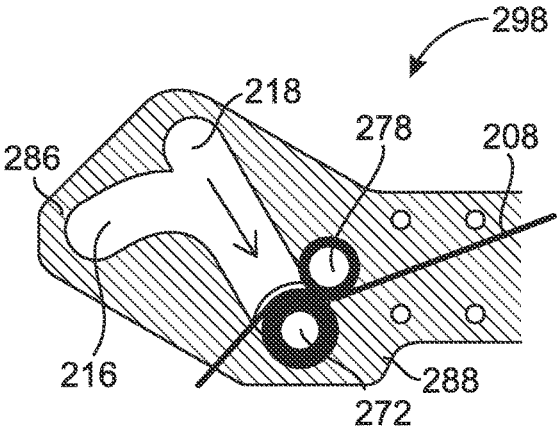
FIG. 6B is a simplified view of the material retainer in the load position.

As seen in the examples in FIGS. 2 and 6A the pinch roller 272 can be in a first configuration for feeding flexible sheet material, more particularly, as seen in FIG. 6A, a pre-load position 296. The pinch roller 272 can also be in a second configuration for retaining flexible sheet material, more particularly, as seen in FIGS. 3 and 6B, a load position 298. In the pre-load position 296, the pinch roller 272 is positioned at the first end 286 of the guide plates 284, 285 within the long end 216 of the elongated slots 294. It can be appreciated that the pinch roller 272 may be slid and rotated from a pre-load position 296 to a load position 298 through the use of force by an operator. To enter the load position 298, as depicted in FIGS. 3 and 6B, the operator may push the pinch roller 272, causing it to slide through the elongated slots 294 from the first ends 286 of the guide plates 284 to the second ends 288, such that the pinch roller 272 sits adjacent to the stationary roller 278. Preferably, the moveable roller is moved about elongated slots 294 of the material retainers 202 from a pre-load position (FIG. 2) to a load position (FIG. 3) with assistance by gravity. As illustrated in FIG. 3, the pinch roller 272, stationary roller 278, and guide plates 284 work together to form a material retainer 202.

In FIG. 6A, the material retainer 202 is in the pre-load position 296, thereby providing a space 300, of a predetermined length, from the pinch roller 272 to the stationary roller 278. This space 300 allows for the material 208 to glide under the stationary roller 278, and over the top surface 266 of the pinch roller 272. Once an operator has situated the material 208 onto the top surface 266 of the pinch roller 272, the operator can push the pinch roller 272 into the load position 298, as seen in FIGS. 3 and 6B. In the example in FIG. 3, this change in configuration presses and secures the material 208 between the pinch roller 272 and the stationary roller 278, thereby creating tension in the fabric for easy spreading. It may be appreciated that the material retainer 202 eliminates the need of assistance from a second operator to ensure the material is evenly spread.

Once the material 208 is securely positioned between the top surface 266 of the pinch roller 272 and the bottom surface (not pictured) of the stationary roller 278, a single operator can swing the swing arm 260 above and over a spreading panel 302. As seen in FIG. 5, the spreading panel 302 comprises a flat table-like structure 304, having a rectangular shape. Attached perpendicularly to the underside of the table-like structure 304 of the spreading panel 302 is a pivot point 280, and attached to the front end 308 of the table-like structure 304 of the spreading panel 302 is a hollow curve. As best seen in FIGS. 2 and 3, the arms 236 are moved with assistance by a spring mechanism 239, which includes a spring 241 extending from each arm 236 to an upright portion 243 of the table-like structure 304.

Figure 4:
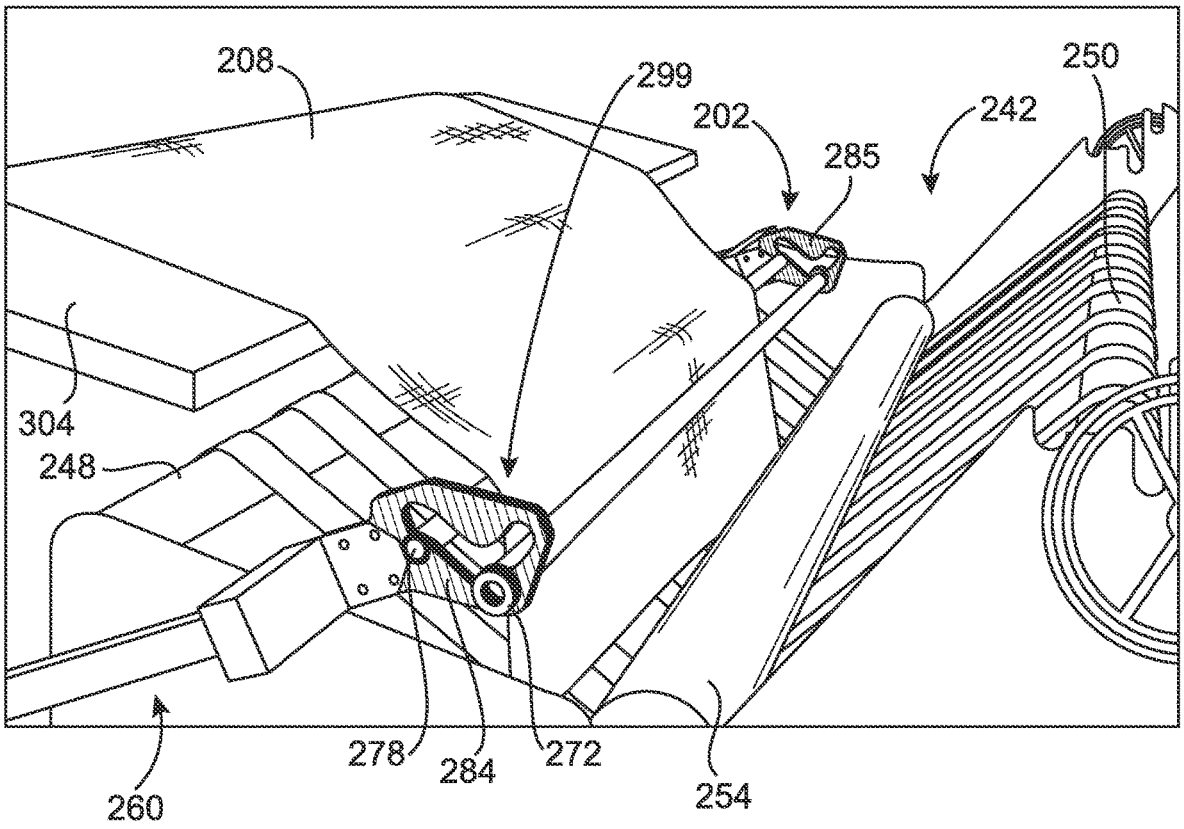
FIG. 4 is a view of the reconfiguration of the material retainer after the light shock load, wherein the material retainer is in the release position, as well as the feeding of the material into the V-shaped cradle.
Figure 6C:
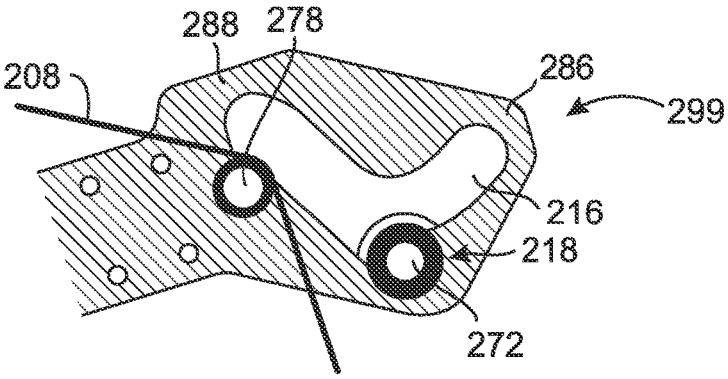
FIG. 6C is a simplified view of the material retainer in the release position after the light shock load has been administered.

The swinging of the material 208 and swing arm 260 over the spreading panel 302, coupled with the tension in the material 208, produced by the load position 298 of the material retainer 202, spreads the fabric tightly over the hollow curve of the flat table-like structure 304 of the spreading panel 302. Once the swing arm 260 swings into a predetermined angle over the spreading panel 302, a hard stop occurs, sending a light shock load to the guide plates 284, 285. As seen in FIGS. 4 and 6C, the swinging of the swing arm 260 causes the guide plates 284, 285 to flip into a third configuration. The light shock load causes the pinch roller 272 to disengage from the material 208 and stationary roller 278 and move into a release position 299. In the example embodiment depicted in FIGS. 4 and 6C, the pinch roller 272 retreats into the release position 299 and the pinch roller moves to the short end 218 of the guide plates 284, 285. This mechanism releases the material 208 into the bottom of the V-shaped cradle 242. As seen in FIG. 4, the V-shaped cradle 242 includes a first roller 248 and a second roller 250, and has a length at least equal to that of the material 208. Between the first roller 248 and the second roller 250 of the V-shaped cradle 242 is a drive roller 254.

When the material 208 is released from the swing arm 260, by the material retainer 202, the material 208 is laid over the first arm 248 of the V-shaped cradle 242 and fed into the tension roller 254. Through the use of a controller 320 and a throttle 322, the drive roller 254 spins, thereby winding the material 208 around itself. The material 208 may then be released over the second arm 250 of the V-shaped cradle 242 in a conventional manner.

The present invention is not to be limited in scope by the specific embodiments described herein. Indeed, various modifications of the present invention, in addition to those described herein, will be apparent to those of ordinary skill in the art from the foregoing description and accompanying drawings. Thus, such modifications are intended to fall within the scope of the invention. Further, although aspects of the present invention have been described herein in the context of a particular implementation in a particular environment for a particular purpose, those of ordinary skill in the art will recognize that its usefulness is not limited thereto and that the present invention can be beneficially implemented in any number of environments for any number of purposes.

What is claimed is:

1. A feed assist apparatus for a flexible sheet material spreader, comprising:

a first arm attached at a first end to one side of the material spreader;

a second arm attached at a first end to another side of the material spreader; and a material retainer attached at a second end of each of the first and second arms, the material retainer having a first configuration for feeding flexible sheet material there-through and a second configuration for retaining flexible sheet material;

wherein the first arm and the second arm are moveable together from a first position adjacent a flexible material supply and a second position adjacent entry to the material spreader; and wherein the material retainer is in the second configuration when the moveable arms are in the first position, and the material retainer is in the first configuration when the moveable arms are in the second position.

2. The feed assist apparatus for a flexible sheet material spreader according to claim 1, wherein the flexible material is fabric.

3. The feed assist apparatus for a flexible sheet material spreader according to claim 1, wherein the material supply is a folded bundle of material.

4. The feed assist apparatus for a flexible sheet material spreader according to claim 1, wherein the material retainer has elongated slots.

5. The feed assist apparatus for a flexible sheet material spreader according to claim 4, wherein the elongated slots has a long end and a short end.

6. The feed assist apparatus for a flexible sheet material spreader according to claim 1, wherein a moveable roller and a non-movable roller are positioned between elongated slots of the material retainers.

7. The feed assist apparatus for a flexible sheet material spreader according to claim 6 wherein the moveable roller is moved about elongated slots of the material retainers from a pre-load position to a load position with assistance by gravity.

8. The feed assist apparatus for a flexible sheet material spreader according to claim 6 wherein the arms are moved with assistance by a spring mechanism.

9. The feed assist apparatus for a flexible sheet material spreader according to claim 8, wherein the moveable roller is a metal tube.

10. The feed assist apparatus for a flexible sheet material spreader according to claim 8, wherein the moveable roller is coated with a uniform elastomer coating along its axial direction, and the width, diameter, and durometer of the elastomer coating may vary depending on the properties of flexible material.

11. The feed assist apparatus for a flexible sheet material spreader according to claim 6 wherein the moveable roller is moved about elongated slots of the material retainers through physical force.

12. The feed assist apparatus for a flexible sheet material spreader according to claim 6, wherein the moveable roller is in the first configuration and the flexible material is draped over the moveable roller.

13. The feed assist apparatus for a flexible sheet material spreader according to claim 6, wherein the moveable roller is in the second configuration and the flexible material is secured between the moveable roller and the non-movable roller.

14. The feed assist apparatus for a flexible sheet material spreader according to claim 1, wherein the flexible material is spread over a spreading panel.

15. The feed assist apparatus for a flexible sheet material spreader according to claim 14, wherein the spreading panel comprises a flat table-like structure.

16. The feed assist apparatus for a flexible sheet material spreader according to claim 14, wherein the spreading panel comprises a hollow curve attached to a flat table-like structure.

17. The feed assist apparatus for a flexible sheet material spreader according to claim 1, wherein the flexible material is pulled over a spreading panel.

18. A feed assist apparatus for a flexible sheet material spreader, comprising:

a first arm attached at a first end to one side of the material spreader;

a second arm attached at a first end to another side of the material spreader; and a material retainer having a means of retaining flexible material, attached at a second end of each of the first and second arms, the material retainer having a pre-load position for feeding flexible sheet material there-through and a load position for retaining flexible sheet material;

wherein the first arm and the second arm have a means for moving together from a first position adjacent a flexible material supply and a second position adjacent entry to the material spreader; and wherein the material retainer is in the load position when the moveable arms are in the first position, and the material retainer is in the pre-load position when the moveable arms are in the second position.

19. A feed assist apparatus for a flexible sheet material spreader, comprising:

a first arm attached at a first end to a first side of a pivot point of the material spreader;

a second arm attached at a first end to a second side of the material spreader; and a material retainer attached at a second end of each of the first and second arms, the material retainer comprising guide plates, a pinch roller, and a stationary roller; and the guide plates having elongated slots with long and short ends;

wherein the material retainers have a first configuration for feeding flexible sheet material there-through and a second configuration for retaining flexible sheet material;

wherein the first arm and the second arm are moveable together from a first position adjacent a flexible material supply and a second position adjacent entry to the material spreader;

wherein the material retainers are in the second configuration when the moveable arms are in the first position, and the guide plates are in the first configuration when the moveable arms are in the second position.

* * * * *